US007112347B2

(12) United States Patent
Jurado et al.

(10) Patent No.: US 7,112,347 B2
(45) Date of Patent: Sep. 26, 2006

(54) SANDWICH PACKAGE AND METHOD OF PACKAGING

(75) Inventors: Elana Jurado, Tempe, AZ (US); Constance French, Caballo, NM (US); Reginald W. Alsbrook, 902 Twining La., Bosque, NM (US) 87006

(73) Assignee: Reginald W. Alsbrook, Bosque, NM (US)

( * ) Notice: Subject to any disclaimer, the term of this patent is extended or adjusted under 35 U.S.C. 154(b) by 4 days.

(21) Appl. No.: 10/864,210

(22) Filed: Jun. 9, 2004

(65) Prior Publication Data

US 2005/0042336 A1 Feb. 24, 2005

Related U.S. Application Data

(60) Provisional application No. 60/477,509, filed on Jun. 10, 2003.

(51) Int. Cl.
*B65B 29/10* (2006.01)
*B65D 81/32* (2006.01)

(52) U.S. Cl. ..... 426/115; 426/120; 426/128; 426/394

(58) Field of Classification Search ..... 426/115, 426/120, 128, 394
See application file for complete search history.

(56) References Cited

U.S. PATENT DOCUMENTS 2,157,169 A * 5/1939 Foster ..... 126/263.01
2,186,435 A * 1/1940 Serr ..... 426/92
2,240,522 A * 5/1941 Serr ..... 426/92
2,510,211 A * 6/1950 Cleary ..... 229/120.32
2,819,738 A * 1/1958 Marberg ..... 141/1
2,824,010 A * 2/1958 Pedersen ..... 426/120
3,043,424 A * 7/1962 Howard ..... 366/150.1
3,088,586 A * 5/1963 Hardman ..... 206/221
3,131,066 A * 4/1964 Mitzelfelt ..... 426/140
3,656,968 A * 4/1972 Allen ..... 426/275
4,137,333 A 1/1979 Daswick
4,154,860 A 5/1979 Daswick
4,703,688 A * 11/1987 Ochs ..... 99/450.8
4,844,330 A 7/1989 Roosa et al.
4,951,866 A 8/1990 Rusnak
5,012,971 A 5/1991 Cozzi et al.
5,039,003 A 8/1991 Gordon et al.
5,213,256 A 5/1993 Cyr
5,567,455 A 10/1996 Alsbrook (Continued)

FOREIGN PATENT DOCUMENTS

DE 4117093 * 11/1992

(Continued)

*Primary Examiner*—Steve Weinstein
(74) *Attorney, Agent, or Firm*—Janeen Vilven; Jeffrey D. Myers; Peacock Myers, P.C.

(57) ABSTRACT

A system which enables fillings (such as sandwich fillings) to be kept separate from bread. The system thus enables the fillings and bread to be stored and transported together without the bread getting soggy. The present invention also provides a way to quickly dispose the fillings within the bread by requiring the user to perform only a single quick motion. A bread is formed to accept a pouch containing filling. The open end of the pouch is folded shut and is placed into the bread. The bread and pouch assembly is placed inside a bag which is sealed with a tab. A tail of the pouch passes through the tab and thus outside the bag. A user pulls the tail of the pouch causing the filling to be squeezed into the bread by the constricting action of the pouch passing through the tab.

20 Claims, 6 Drawing Sheets

U.S. PATENT DOCUMENTS

| | | | |
|---|---|---|---|
| 6,228,406 | B1 | 5/2001 | Borzuta |
| 6,602,528 | B1 | 8/2003 | Wells |

FOREIGN PATENT DOCUMENTS

| | | | |
|---|---|---|---|
| DE | 19946257 | * | 4/2001 |
| EP | 1145636 | * | 10/2001 |
| GB | 2203927 | * | 11/1988 |
| JP | 1-132332 | * | 5/1989 |
| WO | WO-97/40693 | * | 11/1997 |

* cited by examiner

SANDWICH PACKAGE AND METHOD OF PACKAGING

CROSS-REFERENCE TO RELATED APPLICATIONS

This application claims the benefit of the filing of U.S. Provisional Patent Application Ser. No. 60/477,509, entitled "Pullout Pouch Packaging Systems", filed on Jun. 10, 2003, and the specification thereof is incorporated herein by reference.

BACKGROUND OF THE INVENTION

1. Field of the Invention (Technical Field)

The present invention relates to a method and apparatus for storing and filling a sandwich. Particularly, the present invention relates to a method and apparatus for storing moist sandwich filling within the confines of bread while prohibiting the transfer of moisture thereto. The present invention which is both inexpensive and cost effective. The method and apparatus of the present invention further permits a user to deposit the filling within the bread in a quick and clean manner.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

The ability to separate food elements and later recombine them has been known for sometime. For example, U.S. Pat. No. 5,213,256, to Cry discloses a contraption for separating a top half of a burger from a bottom half of the burger. While the contraption may be useful for separating hot and cold sections of a burger, the separation of the buns from the moist portions thereof would necessarily require a user to open the contraption and manipulate the contents. This is because a burger or sandwich typically has bread on the top as well as on the bottom. Since the contraption of Cry only separates a upper half from a lower half, the bread would necessarily need to be stored together in either the upper or lower compartment. Since a user would need to open the contraption, remove the divider and build the burger or sandwich, the user is not provided with a quick and easy manner in which to transfer the moist items onto the bread U.S. Pat. No. 6,228,406, to Borzuta discloses a moisture resistant material which is filled with an inner foodstuff. An outer foodstuff surrounds the jacket. The jacket prevents the transfer of moisture between the two foodstuffs. When a user is ready to combine and eat the two foodstuffs, the user tears away an end piece. The user must then grasp a back tab-like end portion of the jacket. The user must then straddle a back portion of the jacket between two of the users fingers. Then user must then squeeze the two straddling fingers together while simultaneously pulling the jacket from within the outer foodstuff. Since the end portion must first be removed, the outer foodstuff cannot be made to cover the end of the jacket, thus, the inner foodstuff can easily spill and leak from both ends of the outer foodstuff. Also, since the user is pulling the jacket material between his fingers, not only does the user's fingers get outer foodstuff transferred to them (since the jacket material was in direct contact with an inner portion of the outer foodstuff), but the user's fingers stand a significant chance of getting inner foodstuff on them as the last of the inner foodstuff is deposited into the outer foodstuff due to the end of the jacket passing through the user's fingers. Thus, a user should not only wash his hands before handling outer foodstuff in an attempt to dispose inner foodstuff therein, but a user must wash his hands again after the operation to remove the inner and outer foodstuff which is deposited on the users fingers during the filling operation.

While slightly different, U.S. Pat. No. 5,567,455, to Alsbrook Sr. suffers from similar drawbacks. Alsbrook Sr. discloses a sandwich filling contained within a tear away bag, which is itself disposed within an edible baked shell. A user must somehow manage to pull on the tear away bag in such a manner that the bag is torn. In order to keep the filling from getting everywhere, the user must also try to keep the filling in the baked shell while simultaneously removing the torn bag. This can be quite a challenge, particularly if the filling contained within the bag has physical properties which cause the filling to tend to stick to the inside of the tear away bag.

There is thus a need for a method and apparatus which enables moist items to be stored within a bread without the transfer of moisture therebetween, while simultaneously providing a user with a quick and easy manner in which to transfer the moist items into the bread.

BRIEF SUMMARY OF THE INVENTION

The present invention is directed toward a pullout packaging system having one or more breads which can have one or more recesses, an inner pouch having a compartment a sealed portion and a skirt, a bag, a tab that can at least partially encompass a portion of the bag and pouch, and a filling within the inner pouch. The inner pouch is at least partially disposed within the bread recess. The recess is disposed within at least one of the breads, and the one or more breads are disposed within the bag.

An end portion of the pouch can be folded. The bread can have a substantially rectangular shape; the bread can have a substantially rectangular shaped recess; the inner pouch and bag can be a thin flexible plastic material; the tab can be a plastic material; and the filling can be a single solid structure.

Among other things, the bread can be bagels, muffins, biscuits, and tortillas as well as combinations thereof.

The present invention is also directed toward a method for packaging a sandwich with the steps of providing one or more breads having one or more recesses, providing an inner pouch which has a compartment a sealed portion and a skirt, providing a bag, providing a tab, and providing a filling.

The method can also have the steps of disposing the filling within the inner pouch, disposing the inner pouch at least partially within the bread recess, and disposing the one or more breads within the bag. The tab can at least partially encompass a portion of the bag and the pouch.

The method can also have the step of folding an end portion of the pouch. The step of providing one or more breads can include providing one or more breads having a substantially rectangular shape.

The step of providing one or more substantially rectangular shaped breads can include providing one or more substantially rectangular shaped breads with one or more substantially rectangular recess disposed therein. The step of providing an inner pouch can include providing an inner pouch having a thin flexible plastic material. The step of providing a tab can include providing a plastic tab.

The method can also include the step of providing a thin, flexible, plastic bag. The step of providing one or more breads can include providing one or more bagels, muffins, biscuits, tortillas, and combinations thereof. The step of providing a filling can include providing a single solid filling.

An object of the present invention is to provide a method and apparatus for storing a sandwich filling within a bread while preventing the transfer of moisture therebetween. An advantage of the present invention is that a method and apparatus is provided for quickly and easily disposing a stored filling within a bread.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is directed to a method and apparatus for storing moist items along with bread while keeping the bread from getting soggy. The present invention is also directed toward a method and apparatus for combining previously separated components in a quick and efficient manner.

The term "bread" as used throughout the specification and claims is used for the sake of simplicity and is intended to include all food items which can be formed into an edible shell. These include, but are not limited to bread, bagels, muffins, biscuits, tortillas, and combinations of these.

The term "filling" as used throughout the specification and claims is used in an effort to maintain clarity and simplification. Individuals from all walks of life exhibit extremely diverse preferences in what they choose to eat. As such, the term "filling" is intended to include any edible item which can physically fit within the inner pouch. While it is preferred that the filling of the present invention is a single solid log, desirable results can be achieved when the filling is in numerous other forms.

Although a preferred shape of the bread slices, as well as the recess disposed therein, is depicted in the figures as being rectangular, the bread and the recess disposed therein can easily be constructed in virtually any shape including, but not limited to tubular, square, round, and spherical. Further, upon reading this specification, those skilled in the art will readily recognize that multiple recesses can be provided in the bread, and that separate fillings can be provided in a pouch for each recess.

Figure 1:
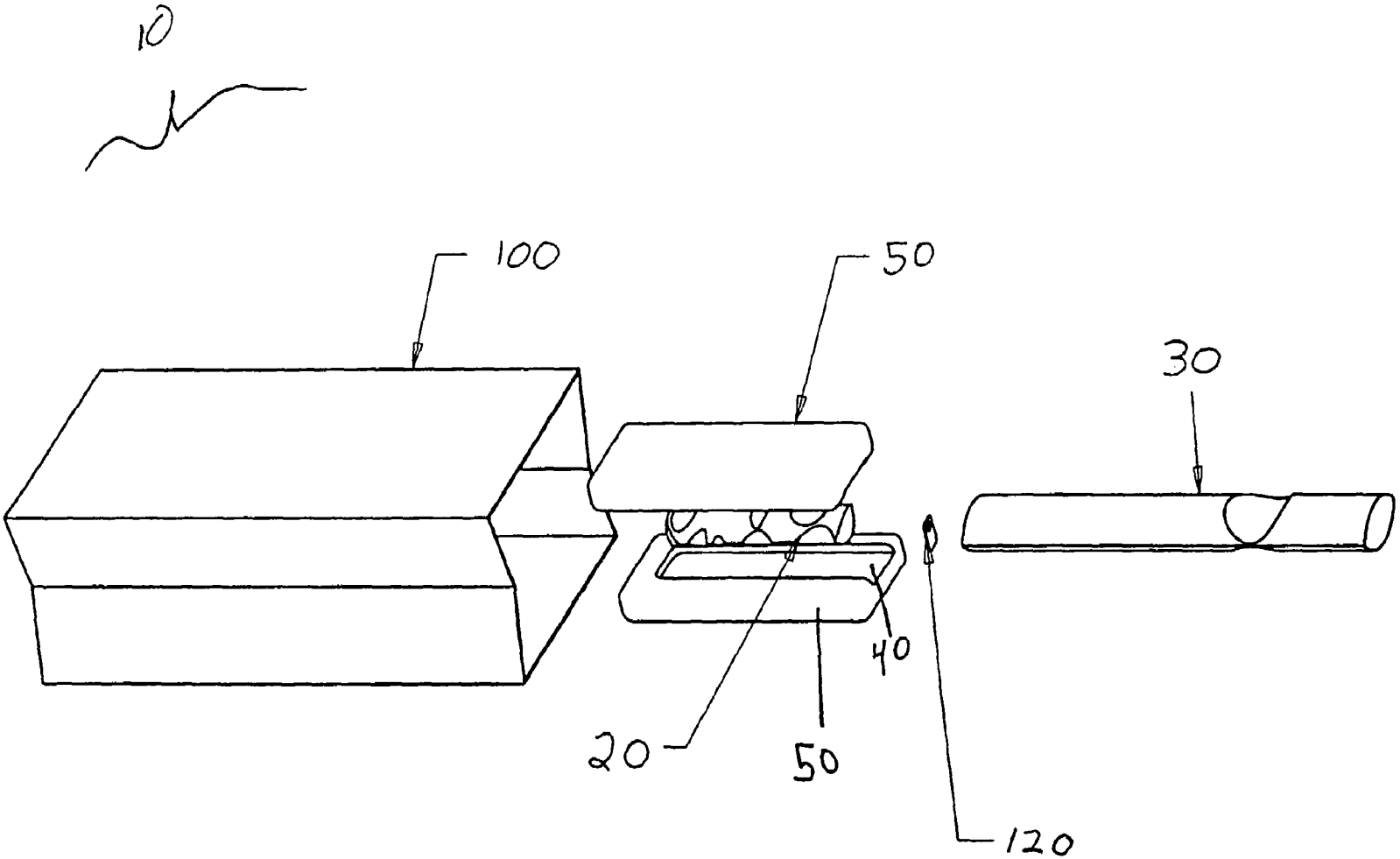
FIG. 1 is an exploded view drawing of the apparatus of the present invention.
Figure 2D:
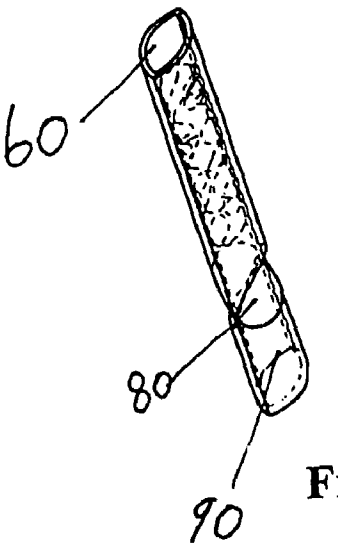
FIGS. 2A–G show various views of the inner pouch of the present invention.
Figure 2C:
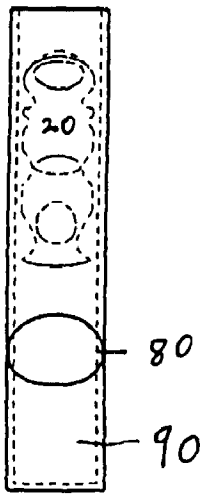
Figure 2B:
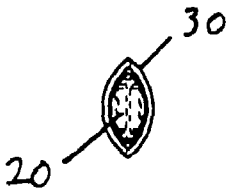
Figure 2A:
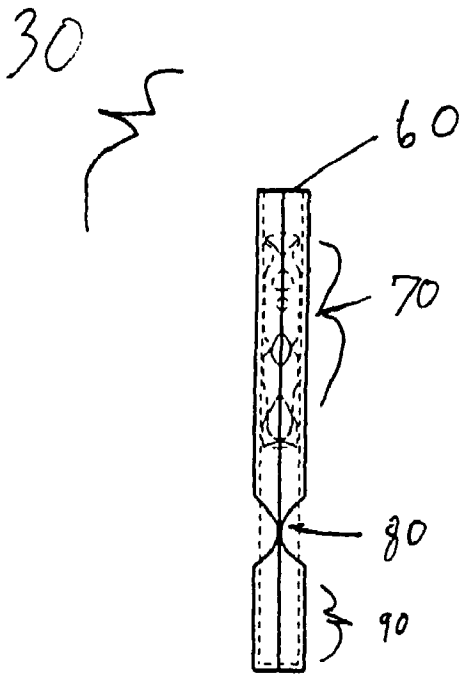
Figure 2E:
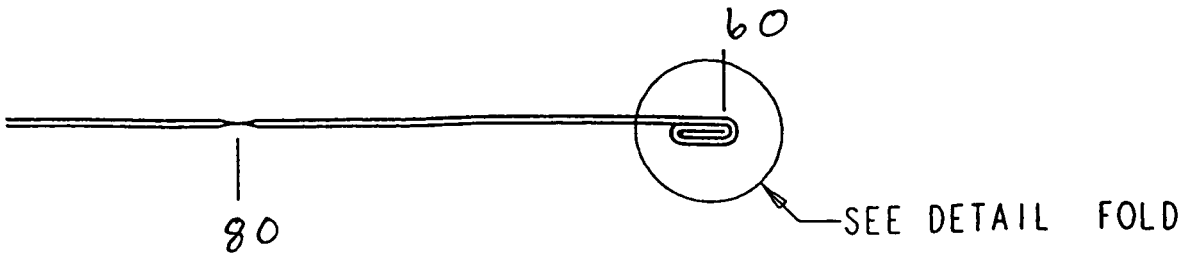
Figure 2F:
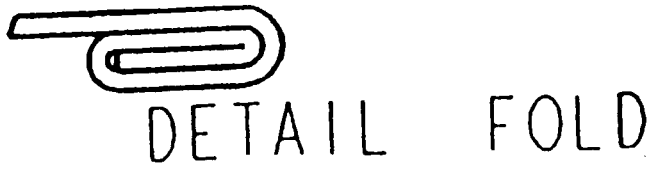
Figure 2F:
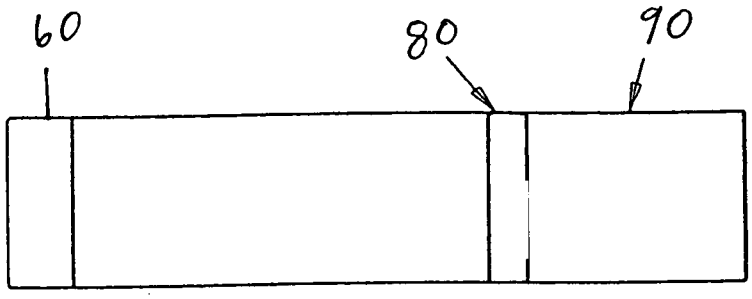
Figure 2G:
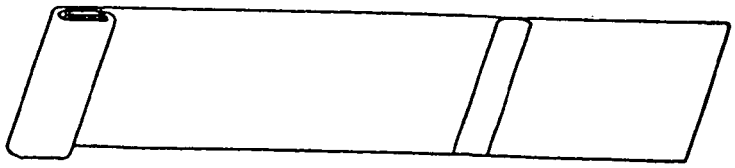
Figure 5A:
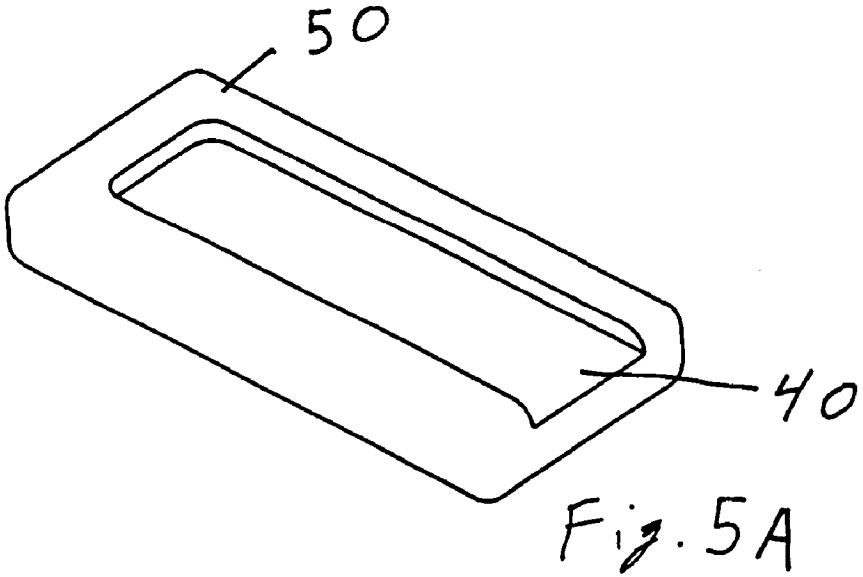
FIGS. 5A & 5B are drawings depicting a preferred embodiment of bread slices as well as the recess disposed therein.
Figure 5B:
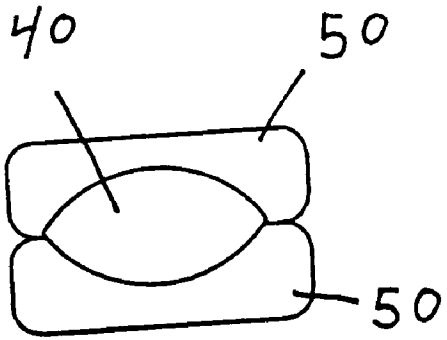

Referring now to the figures, as depicted in FIG. 1, the present invention is a pull-out pouch packaging system 10 which can have filling 20 disposed within inner pouch 30. Pouch 30 and filling 20 are preferably disposed within recess 40 of a first bread slice 50 (see FIG. 5A). A second bread slice 50 is then sandwiched onto first slice 50 (see FIG. 5B).

Referring to FIGS. 2A–D, Inner pouch 30 preferably has opening 60, compartment 70, sealed portion 80, and skirt 90. After filling 20 is disposed within pouch 30, opening 60 is preferably folded shut (see FIG. 3). Pouch 30 is disposed within recess 40 of first bread slice 50 such that folded opening 60 of pouch 30 resides near a distal end of recess 40. The distal end of recess 40 of slice 50 preferably is structured such that when first and second slices 50 are sandwiched together, recess 40 is created having only one opening at a proximal end of recess 40. Thus, when first and second slices 50 are sandwiched together, the distal end of recess 40 is preferably the closed end of recess 40.

Figure 3:
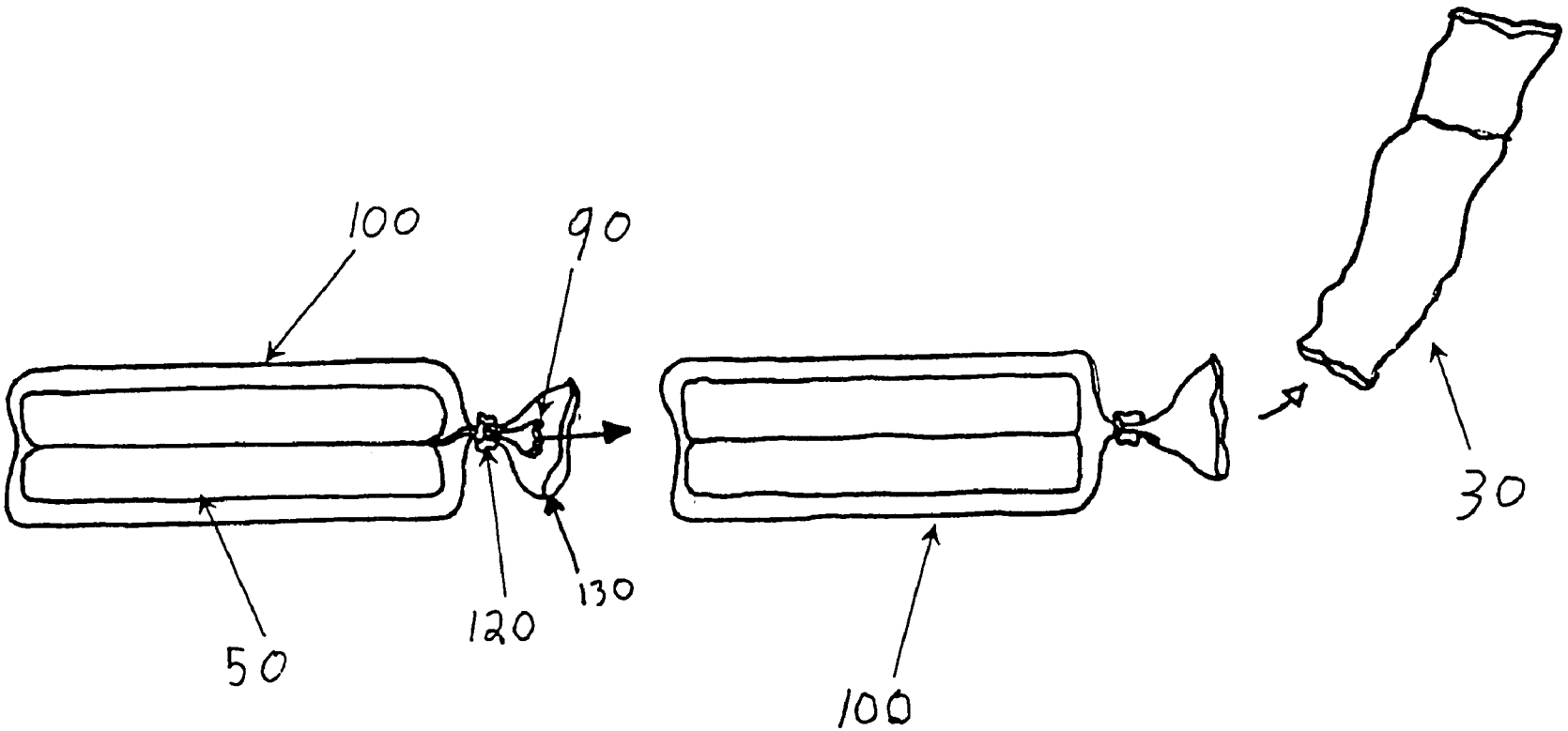
FIG. 3 is a drawing showing the quick and simple operation of the apparatus of the present invention.

After pouch 30 with filling 20 is disposed within first and second slices 50, the entire assembly is disposed within bag 100 such that skirt 90 of pouch 30 resides near opening 110 of bag 100 (see FIG. 3). Tab 120 is then preferably placed around skirt 90 and bag 100 such that tail 130 of bag 100 is created.

To remove filling 20 from pouch 30 and simultaneously deposit it within recess 40 of bread slices 50, a user simply grasps skirt 90 of pouch 30, and pulls pouch 30 though tab 120. Tab 120 causes compartment 70 of pouch 30 to be constricted as it passes through tab 120. This results in filling 20 being forced toward opening 60 from pouch 30. This force causes folded opening 60 to unfurl. After opening 60 has unfurled, further pressure on compartment 70 causes filling 20 to be excreted therefrom. Since pouch 30 resides within recess 40 of slices 50, filling 20 is excreted therein. After pouch 30 has been completely pulled through tab 120, pouch 30 my be disposed of, preferably in a trash or recycling receptacle. A user may then remove tab 120 from bag 100, thus permitting sandwich 140 to be removed therefrom.

Figure 4A:
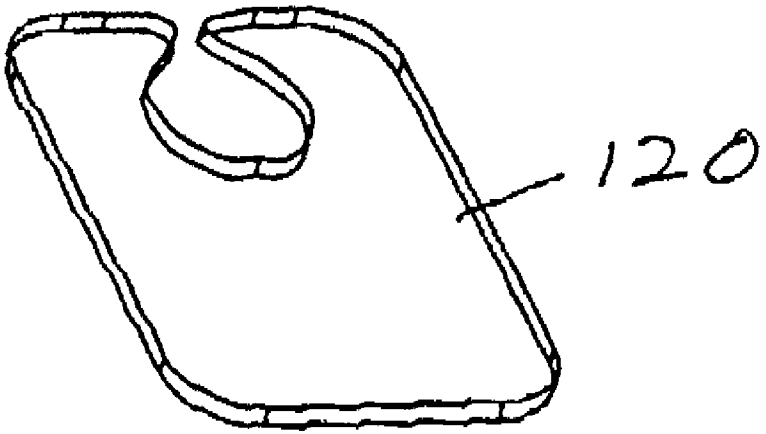
FIGS. 4A & B are isometric and perspective views of a preferred embodiment of the tab of the present invention.
Figure 4B:
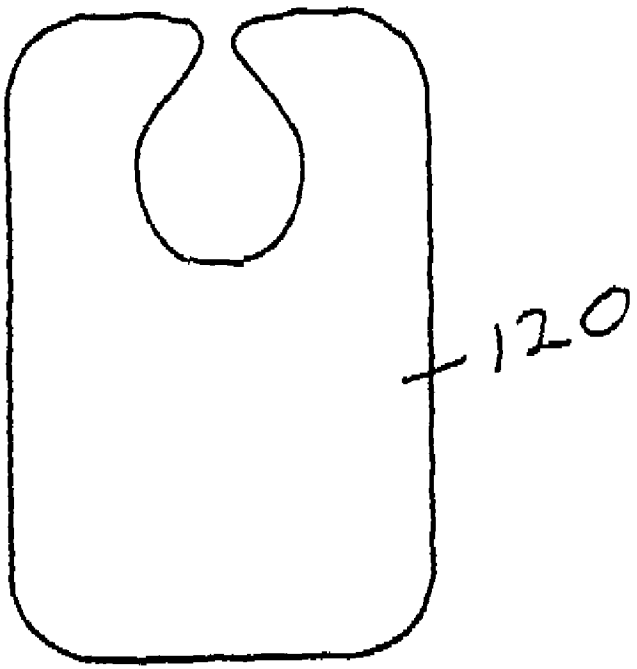

Although the preferred shape of tab 120 is depicted in FIGS. 4A and 4B, upon reading this specification, those skilled in the art will readily recognize numerous other shapes and forms for tab 120 which will also produce desirable results.

While those skilled in the art will readily recognize the vast array of materials from which pouch 30, bag 100 and tab 120 can be made, it is preferred that each is made a plastic material. Further, since the apparatus of the present invention requires nothing more than a couple of plastic bags and a small plastic tab, a very inexpensive and thus cost effective packaging system is provided. Still further, since pouch 30, as well as bag 100, are preferably constructed from a thin plastic film, and can easily be constructed to lie flat (like a new unused trash bag), several thousands of the components of the apparatus of the present invention can be stored in a very small area, which also enables the components to be shipped in small containers, thus resulting in substantial savings in shipping costs.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A pullout packaging system comprising:

one or more breads, said bread comprising one or more recesses;

an inner pouch, said inner pouch comprising a compartment, a skirt at one end of said inner pouch, said skirt separated from said compartment by a sealed portion of said pouch, and an opening into said inner pouch at the opposite end of the pouch from said skirt; said pouch opening being closed by a folded portion of said pouch; said folded portion forming an unfurlable, openable closure;

a filling for said bread; said filling contained in said compartment between said sealed portion and said openable closure of said pouch;

an outer bag having an opening, and a tab;

said filling containing, inner pouch being at least partially disposed within said bread recess, and said one or more breads, containing said filling containing, inner pouch, being disposed within said outer bag;

said tab closing said opening of said outer bag, with said inner pouch and bread contained therein, such that at least a portion of said skirt of said inner pouch extends through and past said tab, such that said skirt of said inner pouch is accessible without removing the tab and opening the outer bag, and such that the rest of said skirt and said inner pouch can be pulled through and past the tab which causes said tab to constrict said inner pouch as it passes through said tab thereby forcing said inner pouch to unfurl and open said inner pouch openable closure and force said filling through said opening in the inner pouch and onto said one or more breads.

2. The system of claim 1 wherein said tab is removeable.

3. The system of claim 1 wherein said bread comprises a substantially rectangular shape.

4. The system of claim 3 wherein said bread comprises a substantially rectangular shaped recess.

5. The system of claim 1 wherein said inner pouch comprises a thin flexible plastic material.

6. The system of claim 1 wherein said tab comprises a plastic material.

7. The system of claim 1 wherein said outer bag comprises a thin flexible plastic material.

8. The system of claim 1 wherein said bread comprises an element selected from the group consisting of: bagels, muffins, biscuits, tortillas, and combinations thereof.

9. The system of claim 1 wherein said filling comprises a single solid structure.

10. The system of claim 1 wherein the folded portion is a trifold.

11. A method for packaging a sandwich comprising:

providing one or more breads, said bread comprising one or more recesses;

providing an inner pouch, said inner pouch comprising a compartment, a skirt at one end of said inner pouch, said skirt separated from said compartment by a sealed portion of said pouch, and an opening into said inner pouch at the opposite end of the pouch from said skirt; said pouch opening being closed by a folded portion of said pouch; said folded portion forming an unfurlable, openable closure;

providing a filling for said bread;

disposing said filling within said inner pouch so that said filling is contained in said compartment between said sealed portion and said openable closure of said pouch;

providing an outer bag having an opening;

providing a tab;

disposing said filling containing inner pouch at least partially within said bread recess;

disposing said one or more breads, containing said filling containing, inner pouch, within said outer bag;

closing said opening of said outer bag with said tab, with said inner pouch and bread contained therein, such that at least a portion of said skirt of said inner pouch extends through and past said tab, such that said skirt of said inner pouch is accessible without removing the tab and opening the outer bag, and such that the rest of said skirt and said inner pouch can be pulled through and past the tab which causes said tab to constrict said inner pouch as it passes through said tab thereby forcing said inner pouch to unfurl and open said inner pouch openable closure and force said filling through said opening in the inner pouch and onto said one or more breads.

12. The method of claim 11 further comprising the step of folding an end portion of the pouch.

13. The method of claim 11 wherein the step of providing one or more breads comprises providing one or more breads having a substantially rectangular shape.

14. The method of claim 13 wherein the step of providing one or more substantially rectangular shaped breads comprises providing one or more substantially rectangular shaped breads with one or more substantially rectangular recess disposed therein.

15. The method of claim 11 wherein the step of providing an inner pouch comprises providing an inner pouch comprising a thin flexible plastic material.

16. The method of claim 11 wherein the step of providing a tab comprises providing a plastic tab.

17. The method of claim 11 wherein the step of providing a bag comprises providing a thin, flexible, plastic bag.

18. The method of claim 11 wherein the step of providing one or more breads comprises providing one or more elements selected from the list consisting of: bagels, muffins, biscuits, tortillas, and combinations thereof.

19. The method of claim 11 wherein the step of providing a filling comprises providing a single solid filling.

20. The method of claim 11 wherein the folded portion is a trifold.

* * * * *